United States Patent [19]

Ohtsuka et al.

[11] Patent Number: 4,854,889

[45] Date of Patent: Aug. 8, 1989

[54] MINIATURE ELECTRICAL CONNECTOR

[75] Inventors: Hiroo Ohtsuka, Utsunomiya; Osamu Hara, Kodaira; Akira Hori, Nagoya; Minoru Nodoa, Ichinomiya, all of Japan

[73] Assignees: Daiichi Denshi Kogyo Kabushiki Kaisha; Iwatsu Electric Co., Ltd.; Tomei Tsushin Kogyo Co., Ltd., all of Japan

[21] Appl. No.: 197,853

[22] Filed: May 24, 1988

[30] Foreign Application Priority Data

May 28, 1987 [JP] Japan ..... 62-79778[U]
May 28, 1987 [JP] Japan ..... 62-79779[U]

[51] Int. Cl.[4] ..... H01R 4/24
[52] U.S. Cl. ..... 439/395; 439/400
[58] Field of Search ..... 439/391–413, 439/417, 425, 426, 744, 746, 750, 883, 868, 888, 741, 743, 748, 749

[56] References Cited

U.S. PATENT DOCUMENTS

| | | | |
|---|---|---|---|
| Re. 27,540 | 1/1973 | Kinkaid | 439/749 |
| 2,181,576 | 11/1939 | Chirelstein | 439/391 |
| 3,110,329 | 11/1963 | Thomme et al. | 439/395 |
| 3,308,417 | 3/1967 | Hammell et al. | 439/746 |
| 3,990,762 | 11/1976 | Lemesle | 439/395 |
| 4,114,975 | 9/1978 | Weidler | 439/395 |
| 4,697,864 | 10/1987 | Hayes et al. | 439/741 |

FOREIGN PATENT DOCUMENTS

| | | | |
|---|---|---|---|
| 62-171159 | 10/1987 | Japan . | |
| 0635943 | 4/1950 | United Kingdom | 439/391 |

*Primary Examiner*—David Pirlot
*Attorney, Agent, or Firm*—Silverman, Cass, Singer & Winburn, Ltd.

[57] ABSTRACT

An electrical connector includes contacts to be connected to lead wires and a housing having apertures for receiving the contacts. The lead wires are connected to the contacts when the contacts are forced into the apertures of the housing. Each of the contacts comprises at one end a contact element to be in contact with an external terminal and at the other end a connection portion formed with a lead aperture through which a lead wire passes and with a slit continuous with the lead aperture. Edges of the slit pierce into an insulating coating of the lead wire and connect with a core of the lead wire under pressure. The housing is formed with through-apertures through each of which the contact element of each of the contacts extends and with receiving apertures each for receiving the lead wire under a condition that the edges of the slit of the connection portion of the contact pierce into the insulating coating of the lead wire and connect with the core of the lead wire under pressure and a remaining insulating coating is doubled. A doubled end of the lead wire received in each of the receiving apertures is positioned by a shoulder formed by a boundary wall between the receiving aperture and the through-aperture.

8 Claims, 4 Drawing Sheets

MINIATURE ELECTRICAL CONNECTOR

BACKGROUND OF THE INVENTION

This invention relates to a miniature connector for use in electronic appliances such as telephone sets, and more particularly to a miniature electrical connector having a characteristic feature in construction for connecting contact pins and lead wires of the connector.

FIG. 1 illustrates one example of hitherto used connecting construction of an electrical connector. In this case, an insulating coating 11B of a lead wire 11 is partially removed to expose core 11A which is then clenched in a clamping portion 12A of a junction member 12. On the other hand, a contact pin 13 is clenched in a clamping portion 12B of the junction member 12 to integrally connect the lead wire 11 and the contact pin 13. If the clenching of the clamping portions 12A and 12B of the junction member 12 is insufficient, its electrical connection is unstable. On the other hand, if the core 11A and the contact pin 13 are clenched too much, disconnection is often caused in the junction member 12. Therefore, control of the clenching of the lead wire 11 and the contact pin 13 is difficult.

The miniature connector of this kind has been often used for connection for telephone units or the like. In this case, as shown in FIG. 2 a flat male terminal A-1 is planted in an acoustic unit A, while one end of a lead wire B is clenched in a clamping portion B-2 of a female terminal B-1 which is adapted to be fitted on the male terminal A-1 to establish a connection of the sound unit A and the lead wire B. In fitting the female terminal B-1 on the male terminal A-1, it is very troublesome to grasp the clamping portion B-2 of the female terminal B-1. If the fitting of the male and female terminals A-1 and B-1 is incomplete, a connection between the female terminal B-1 and the clenched clamping portion B-2 is subjected to an excess force to cause a deformation of the connection.

As recent electronic appliances are required to be small and thin, the clamping portion B-2 is often folded toward the female terminal B-1 substantially at right angles into an L-shape so that the clamping portion B-2 is arranged so as not extend very much beyond a height of the male terminal A-1. On the other hand, however, the male terminal A-1 is required to have a height so much as those hitherto used in order to ensure the reliability in connection. Therefore, it has been expected for long to make the clamping portion B-2 as low as possible and to eliminate the disadvantages above described.

SUMMARY OF THE INVENTION

It is a primary object of the invention to provide a miniature electrical connector which eliminates all the disadvantages of the prior art by simplified connection steps and has a lead wire connection construction which realizes a stable connected condition of the led wire.

It is another object of the invention to provide an improved miniature electrical connector which is low in height and simple in construction and is suitable for automatic assembling.

In order to achieve these objects, in an electrical connector including contacts to be connected to lead wires and a housing having apertures for receiving said contacts, said lead wires being connected to said contacts when the contacts are forced into said apertures of the housing, according to the invention each of said contacts comprises at one end a contact element to be in contact with an external terminal and at the other end a connection portion formed with a lead aperture through which a lead wire passes and with a slit continuous with said lead aperture, whose edges pierce into an insulating coating of said lead wire and connect with a core of the lead wire under pressure, and said housing is formed with through-apertures through each of which said contact element of each of the contacts extends and with receiving apertures each for receiving the lead wire under a condition that said edges of said slit of the connection portion of the contact pierce into the insulating coating of said lead wire and connect with the core of the lead wire under pressure and a remaining insulating coating is doubled, a doubled end of said lead wire received in each of said receiving apertures being positioned by a shoulder formed by a boundary wall between the receiving aperture and the through-aperture.

In a second aspect of the invention, the each contact element to be connected to the external terminal is formed as a contact terminal and is connected to the connection portion in a perpendicular relation by a connecting member, and the housing is further formed with contact terminal receiving portions each for receiving the contact terminal of each of the contacts.

In order that the invention may be more clearly understood, preferred embodiments will be described, by way of example, with reference to the accompanying drawings.

DESCRIPTION OF THE PREFERRED EMBODIMENTS

Figure 3:
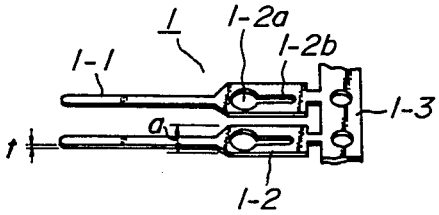
FIGS. 3 and 4 are perspective views illustrating one embodiment of a connector according to the invention.

FIG. 3 illustrates contacts 1 used for a connector according to the invention. The contact 1 comprises at one end a contact element 1-1 for connecting it to an external terminal and at the other end a connection portion 1-2 for connecting a lead wire 11. The connection portion 1-2 is formed with a lead aperture **1-2*a* through which the lead wire 11 passes and a slit 1-2*b* whose edges pierce into an insulating coating 11B and connect with a core 11A under pressure. These contacts 1 are connected by a connecting piece 1-3** before assembling a connector.

Figure 4:
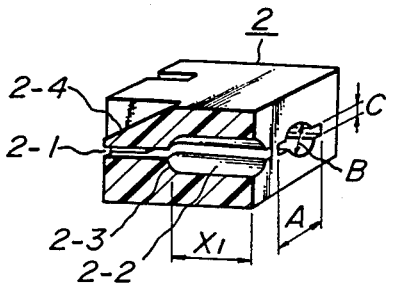

FIG. 4 illustrates a housing 2 for accommodating therein the contacts 1. The housing 2 is formed with through-apertures 2-1 through which the contact elements 1-1 pass, receiving apertures 2-2 for receiving lead wires 11 connected to the connection portions 1-2 of the contacts 1, shoulders 2-3 forming boundary walls between the through-apertures 2-1 and the receiving apertures 2-2, and oblique portions 2-4 for facilitating connecting the contact elements 1-1 to the external terminals and bending the contact element 1-1 extending from the through-aperture 2-1 toward the housing to prevent the contact from removing from the housing as later described. Dimensions A and C of the receiving apertures 2-2 are determined by a width a and a thickness t of the contact 1, while a dimension B of the apertures 2-2 for receiving the lead wire 11 doubled in two 180 degree bends is determined by twice an outer diameter d of the lead wire 11 and the thickness t of the contact.

Figure 5A:
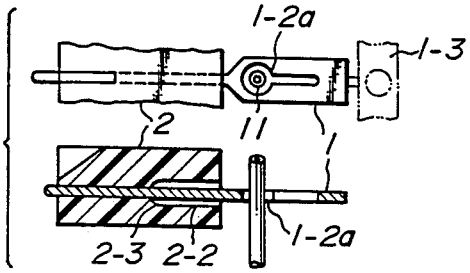
FIGS. 5*a*, 5*b* and 5*c* are sectional views illustrating steps of connecting a lead wire to the connector according to the invention.
Figure 5C:
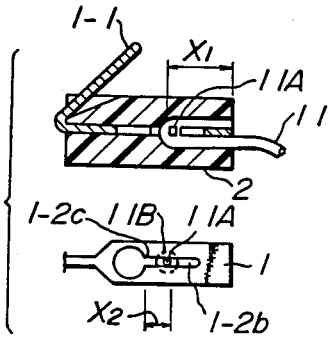
Figure 5B:
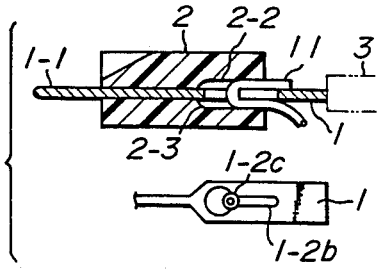

FIGS. 5*a*, 5*b* and 5*c* illustrate steps of connecting the lead wire 11 to the contact 1 and receiving the lead wire 11 in the housing 2. In FIG. 5*a*, the lead wire 11 has passed through the lead aperture 1-2*a* of the contact 1 and the contact 1 has been removed from the connecting piece 1-3. In FIG. 5*b*, the contact 1 is being pushed into the housing 2 by a pushing tool 3 and the lead wire 11 engaging an entrance 1-2*c* of the slit 1-2*b* has been doubled and is being pushed into the housing 2. In FIG. 5*c*, the doubled lead wire 11 has been pushed to a depth $X_1$ of the receiving aperture 2-2 and stopped at the shoulder 2-3 and contact 1 has been pushed further a depth $X_2$. In this final position, the edges of the slit 1-2*b* pierce into the insulating coating 11B of the lead wire 11 at the entrance 1-2*c* of the slit 1-2*b*, and the core 11A is embraced by the edges of the slit 1-2*b* and connected thereto. The core 11A of the lead wire 11 is usually a strand. However, as the folded end of the lead wire 11 is at the contacting point with the slit 1-2*b*, the stranded wires are received therein as a single wire without separating from one another.

In this embodiment, as shown in FIG. 5*c*, after the contact 1 has been inserted into the housing 2, the contact element 1-1 of the contact 1 is bent back toward the housing 2 as shown in FIG. 5*c*, thereby preventing the contact 1 from being dislodged from the housing 2. When the contact element 1-1 contacts an external terminal, the bent contact element 1-1 is further bent toward the oblique portion 2-4.

Figure 6:
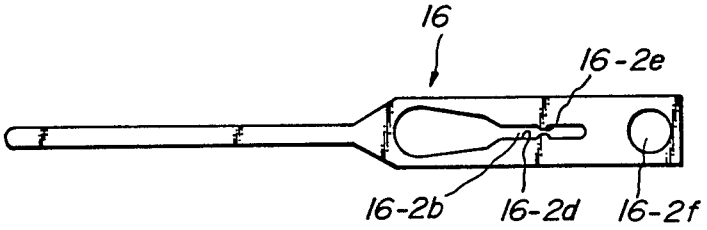
FIG. 6 is a plan view of a contact which is a modification of the contact shown in FIG. 3.

FIG. 6 illustrates another embodiment of a contact 16 used in the invention, whose connection portion, particularly slit is modified. There are provided at a substantially mid portion of core contacting edges 16-2*d* of the slit 16-2*b* lead wire anchoring portions 16-2*e* for anchoring an exposed core and connecting it thereto under pressure. The contact 16 is formed in a unitary body from a metal plate by punching. Other portions of the contact 16 are substantially similar to those shown in FIGS. 3 and 4.

The lead wire anchoring portions 16-2*e* are preferably used because the lead wire is securely anchored to the contact 1 even if an anchoring force for the lead wire by the receiving aperture 2-2 is relatively small such as the case that the depth $X_1$ of the lead wire receiving aperture 2-2 is relatively shallow.

Figure 7:
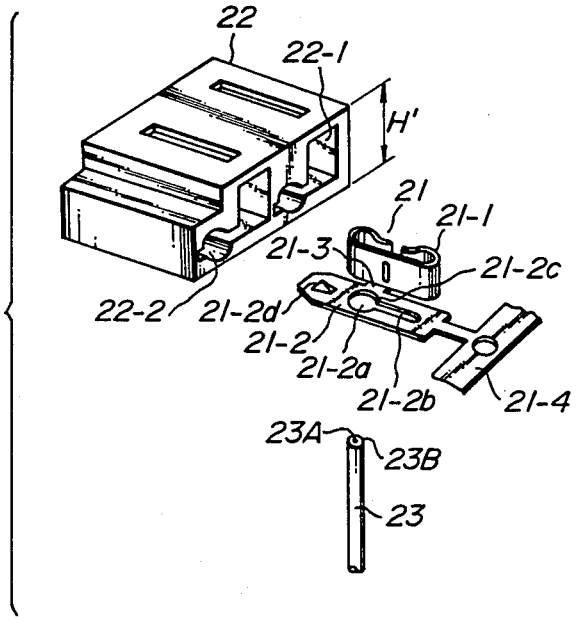
FIG. 7 is a perspective view illustrating another embodiment of the connector according to the invention.

FIG. 7 illustrates a further embodiment of the invention. A contact 21 comprises at one end a contact terminal 21-1 for connecting it to an external male terminal and at the other end a connection portion 21-2 for connecting a lead wire 23. The connection portion 21-2 is formed with a lead aperture 21-2*a* through which a lead wire 23 passes and a slit 21-2*b* whose edges pierce into an insulating coating 3B of the lead wire 23 and contact a core 23A of the lead wire 23 under pressure.

Reference numeral 21-2*c* denotes an entrance of the slit 21-2*b*. An anchoring lug 21-2*d* rising from the connection portion 21-2 serves to prevent the contact 21 from removing from a housing after being accommodated in the housing. A connecting member 21-3 connecting the contact terminal 21-1 and the connection portion 21-2 perpendicular to each other. The connecting member 21-3 is arranged on the connection portion 21-2 so as not to detrimentally affect a width dimension of the slit 21-2*b*. A connecting piece 21-4 connects contacts 21 as a unitary body before assembling the connector.

Figure 8A:
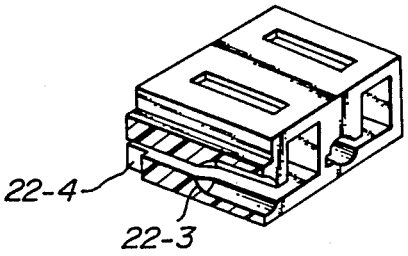
FIGS. 8*a*, 8*b* and 8*c* are partial sectional views of the housing shown in FIG. 7.
Figure 8B:
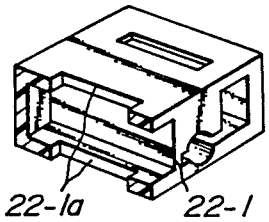

A housing 22 is formed with receiving portions 22-1 for receiving contact terminals 21-1, respectively, and receiving apertures 22-2 for receiving lead wires 23 supported by connection portions 21-2. The receiving portions 22-1 and the receiving apertures 22-2 communicate with each other through slits corresponding to thicknesses of the contacts 21. As shown in FIGS. 8*a* and 8*b*, the housing 22 is formed with shoulders 22-3 at bottoms of the receiving apertures 22-2 to prevent the lead wires 23 from entering further, and notches 22-4 with which the anchoring lugs 21-2*d* engage. The housing 22 is formed in upper and lower surfaces with elongated openings 22-1*a* to permit male terminals A-1 to pass therethrough and regulate upward and downward movements of the contact terminals 21-1 when the male terminals A-1 are attached to and removed from the contact terminals 21-1.

Figure 8C:
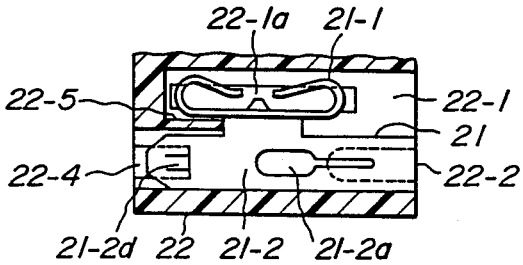

As shown in FIG. 8*c*, the housing 22 is further integrally formed with wall members 22-5 each located between the contact terminal 21-1 and the connection portion 21-2 of the contact 21 inserted into the housing 22. When the contact 21 is inserted into the housing 22, a side edge of the connecting member 21-3 abuts against the wall member 22-5 so that the wall member 22-5 serves as a stopper for stopping the further advance of the contact 21.

Figure 9A:
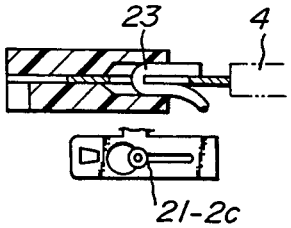
FIGS. 9*a* and 9*b* are sectional views illustrating steps of connecting a lead wire to the connector shown in FIG. 7.
Figure 9B:
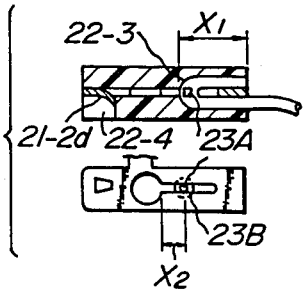

FIGS. 9*a* and 9*b* illustrate steps of connecting the lead wire 23 to the contact 21 and receiving the lead wire 23 in the housing 22. Although the conditions in these steps are explained simplified in order to facilitate the understanding, an insulating coating of a lead wire is often prematurely pierced by the edges of the slit 21-2*b* owing to resisting force of the receiving aperture 22-2 acting upon the lead wire. In FIG. 9*a*, after the lead wire 23 has passed through the lead aperture 21-2*a* and the contact 21 has been removed from the connecting piece 21-4, the contact 21 is being inserted into the housing 22 by a pushing tool 4, and the lead wire 23 engaging the entrance 21-2*c* has been doubled and enclosed in the receiving aperture 22-2. In FIG. 9*b*, the doubled lead wire 23 has been pushed to a depth $X_1$ of the receiving aperture 22-2 and stopped at the shoulder 22-3 and the contact 21 has been pushed further a depth $X_2$. In this final position, the edges of the slit 21-2*b* pierce into the insulating coating 23B of the lead wire 23 at the entrance 21-2*c* of the slit 21-2*b* and the core 23A is embraced by the edges of the slit 21-2*b* and connected thereto. In this position, the anchoring lug 21-2*d* engages the notch 22-4 of the housing 22.

Figure 1:
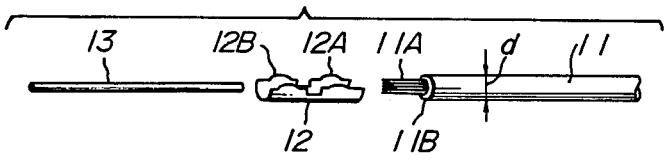
FIG 1 PRIOR ART
FIG. 1 is a perspective view illustrating a connection construction of a miniature electrical connector of the prior art.
Figure 2A:
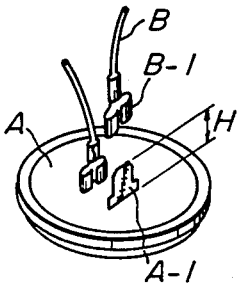
FIG 2a PRIOR ART
FIGS. 2*a* and *b* is a perspective view illustrating a construction of connecting members of the prior art.
Figure 2B:
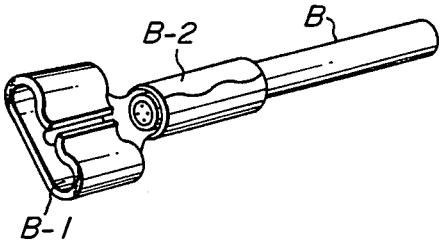
FIG 2b PRIOR ART

With this arrangement, the height of the connection portion 21-2 can be lower by the length of the clamping portion B-2 in FIG. 2*b* so that it is possible to make the height H' of the housing 22 (FIG. 7) substantially equal to the height H of the male terminal A-1 (FIG. 2*a*). Moreover, as the slit of the connection portion is parallel to the contact terminal, for example, the two-contact connector can be realized as in this embodiment without changing pitches of hitherto used male terminals A-1.

As can be seen from the above explanation, according to the invention a doubled lead wire is being inserted into a lead wire receiving aperture, while at the same time the insulating coating of the lead wire is pierced by edges of the slit of a contact to connect the contact with the lead wire. Therefore, the operation for connecting the lead wire is very simplified and no clamping member is needed which was essential in connecting the lead wire. On the other hand, the contact terminal 21-1 is arranged perpendicular to the connection portion 21-2 according to the invention. Accordingly, it is possible to provide the connector which is low in height which has never been realized, and which is simple in construction, minimum in number of parts and inexpensive and is suitable for automatic assembling.

Example

An actual connector as shown in FIGS. 7 and 8 will be explained hereinafter.

A lead wire 23 included a strand as a core conductor and had an insulating coating of an outer diameter of about 1 mm. A contact 21 was made of a phosphor bronze having a thickness of 0.4 mm. The contact 21 had a connection portion 21-2 having a 10 mm length and a 2 mm width, a slit **21-2*b* having a 0.2–0.3 mm width, and a contact terminal 21-1** having a length of about 5 mm and a height of about 3 mm.

A housing 22 was made of an insulating resin and had lead line receiving apertures 22-2 each having an elliptical cross section whose short axis was about 1.5 mm in a width direction and long axis was about 2.5 mm in a height direction. The material of the housing 22 may be made of any material which has been used for housings of electrical connectors. It holds true in the contact 21. The material of the contact 21 may be made of any material which has been used for contacts for electrical connectors. With the above construction, the height H' of the housing 22 was about 5 mm.

The contact 16 shown in FIG. 6 will be explained. This contact 16 is similar to that shown in FIG. 3 with exception of the anchoring portions **16-2*e*. The anchoring portions 16-2*e* were formed as projections integrally extending inwardly about 0.05 mm from the edges of the slit 16-2*b*** at a mid point thereof by punching with press-dies.

The contact 16 was formed in one end opposite to a contact element with an insulating coating releasing aperture **16-2*f* which was a simple aperture having a diameter of about 1 mm. When a lead wire was received in a lead wire receiving aperture of a housing, parts of an insulating coating of a lead wire extended into the aperture 16-2*f*** so that the lead wire became stable thereby releasing stresses in the connected core of the lead wire to ensure the complete electrical connection.

It is further understood by those skilled in the art that the foregoing description is that of preferred embodiments of the disclosed connectors and that various changes and modifications may be made in the invention without departing from the spirit and scope thereof.

What is claimed is:

1. An electrical connector including contacts to be connected to lead wires and a housing having apertures for receiving said contacts, said lead wires being connected to said contacts when the contacts are forced into said apertures of the housing, wherein each of said contacts comprises at one end a contact element to be in contact with an external terminal and at the other end a connection portion formed with a lead aperture through which a lead wire passes and with a slit continuous with said lead aperture, whose edges pierce into an insulating coating of said lead wire and connect with a core of the lead wire under pressure, and said housing is formed with through apertures through each of which said contact element of each of the contacts extend and with receiving apertures each for receiving the lead wire under a condition that said edges of said slit of the connection portion of the contact pierce into the insulating coating of said lead wire and connect with the core of the lead wire under pressure and a remaining insulating coating is doubled, a doubled end of said lead wire received in each of said receiving aperture being positioned by a shoulder formed by a boundary wall between the receiving aperture and the through-aperture, said housing including an oblique portion for facilitating connecting said contact element of each of said contacts to said external terminal and bending said contact element extending from said through-aperture toward said housing to prevent removal of said contact from said housing.

2. An electrical connector as set forth in claim 1, wherein each of said contacts is formed with lead wire anchoring portions integrally extending inwardly of said slit from the edges thereof, said anchoring portions being in opposition to each other.

3. An electrical connector as set forth in claim 1, wherein each of the contacts is formed with an aperture as an insulating coating releasing aperture in a portion of the contact to be in contact with the doubled lead wire.

4. An electrical connector including contacts to be connected to lead wires and a housing having apertures for receiving said contacts, said lead wires being connected to said contacts when the contacts are forced into said apertures of the housing, wherein each of said contacts comprises at one end a contact element to be in contact with an external terminal and at the other end a connection portion formed with a lead aperture through which a lead wire passes and with a slit continuous with said lead aperture, whose edges pierce into an insulating coating of said lead wire and connect with a core of the lead wire under pressure, said connection portion of each of said contacts being formed with an engaging lug extending from a surface of the connection portion to be engaged with a notch formed in said housing when said contact is completely inserted in said housing, and said housing is formed with through-apertures through each of which said contact element of each of the contacts extend and with receiving apertures each for receiving the lead wire under a condition that said edges of said slit of the connection portion of the contact pierce into the insulating coating of said lead wire and connect with the core of the lead wire under pressure and a remaining insulating coating is doubled, a doubled end of said lead wire received in each of said receiving apertures being positioned by a shoulder formed by a boundary wall between the receiving aperture and the through-aperture.

5. An electrical connector as set forth in claim 4, wherein said each contact element to be connected to the external terminal is formed as a contact terminal and is connected to the connection portion in a perpendicular relation by a connecting member, and said housing is further formed with contact terminal receiving portions each for receiving the contact terminal of each of said contacts.

6. An electrical connector as set forth in claim 4, wherein each of said contacts is formed with lead wire anchoring portions integrally extending inwardly of said slit from the edges thereof, said anchoring portions being in opposition to each other.

7. An electrical connector as set forth in claim 4, wherein each of the contacts is formed with an aperture as an insulating coating releasing aperture in a portion of the contact to be in contact with the doubled lead wire.

8. An electrical connector including contacts to be connected to lead wires and a housing having apertures for receiving said contacts, said lead wires being connected to said contacts when the contacts are forced into said apertures of the housing, wherein each of said contacts comprises at one end a contact element to be in contact with an external terminal and at the other end a connection portion formed with a lead aperture through which a lead wire passes and with a slit continuous with said lead aperture, whose edges pierce into an insulating coating of said lead wire and connect with a core of the lead wire under pressure, and said housing is formed with through-apertures through each of which said contact element of each of the contacts extend and with receiving apertures each for receiving the lead wire under a condition that said edges of said slit of the connection portion of the contact pierce into the insulating coating of said lead wire and connect with the core of the lead wire under pressure and a remaining insulating coating is doubled, a doubled end of said lead wire received in each of said receiving apertures being positioned by a shoulder formed by a boundary wall between the receiving aperture and the through-aperture, each contact element to be connected to the external terminal being formed as a contact terminal and being connected to the connection portion in a perpendicular relation by a connecting member, and said housing is further formed with contact terminal receiving portions each for receiving the contact terminal of each of said contacts.

* * * * *